US008770588B2

(12) United States Patent
Hammer

(10) Patent No.: US 8,770,588 B2
(45) Date of Patent: Jul. 8, 2014

(54) NOVELTY BEVERAGES STRAW

(76) Inventor: Douglas Taylor Hammer, Greenville, SC (US)

( * ) Notice: Subject to any disclaimer, the term of this patent is extended or adjusted under 35 U.S.C. 154(b) by 2705 days.

(21) Appl. No.: 11/266,715

(22) Filed: Nov. 3, 2005

(65) Prior Publication Data

US 2006/0065758 A1 Mar. 30, 2006

Related U.S. Application Data

(62) Division of application No. 10/725,786, filed on Dec. 1, 2003, now abandoned.

(51) Int. Cl.
*A63F 9/00* (2006.01)

(52) U.S. Cl.
USPC ..... 273/453; 273/440; 273/457; 273/459

(58) Field of Classification Search
USPC ..... 273/110, 451, 453, 457, 459
See application file for complete search history.

(56) References Cited

U.S. PATENT DOCUMENTS

| | | | | |
|---|---|---|---|---|
| 4,699,318 | A * | 10/1987 | Donatello et al. | 239/33 |
| 5,361,987 | A * | 11/1994 | Matheussen et al. | 239/33 |
| 5,375,828 | A * | 12/1994 | Shikami | 273/110 |
| 6,511,693 | B2 * | 1/2003 | Jones | 426/565 |
| 2005/0116057 | A1 * | 6/2005 | Hamer | 239/16 |
| 2006/0065758 | A1 * | 3/2006 | Hamer | 239/33 |
| 2006/0144955 | A1 * | 7/2006 | Farnsworth et al. | 239/33 |

OTHER PUBLICATIONS

"Fun with Jell-O", Woody White, The Greenville News, Business Section, Week of Sep. 11, 2005, pp. 1,6.*

* cited by examiner

*Primary Examiner* — Raleigh W Chiu
(74) *Attorney, Agent, or Firm* — Nexsen Pruet, LLC

(57) ABSTRACT

A novelty item for parties and other amusement which is a straw containing a jellied shooter, a granita or a slush. Preferably the jellied shooter, the granita or slush contains a potable alcohol. Alternative embodiments incorporate a holder for multiple straws which may be operably connected to each other.

2 Claims, 3 Drawing Sheets

NOVELTY BEVERAGES STRAW

FIELD OF THE INVENTION

This invention relates to novelty or party supplies and in particularly to a straw to be used by two people to share a viscous drink in a humorous and quasi-competitive manner. The most suitable drinks are gelled fruit flavored drinks and granitas or slushes. Alcoholic beverages may be included in the drink.

BACKGROUND OF THE INVENTION

Numerous party favors or "gag gifts" are available commercially including many various designs for straws. Representative is U.S. Pat. No. 6,062,488 to McCafferty, wherein a straw is run through an "action figure." Multiple straw designs, such as U.S. Pat. No. 4,699,318 to Donatello et al. allow multiple drinkers to sip from the same container, in this particular case, a pitcher.

Adult parties frequently serve alcoholic beverages and fruit-flavored drinks and shooters and are particularly popular in the summer and at beach resorts. Tooters shooters, a product of Mango Bottling Company, are a good example of pre-packaged fruit-flavored shooters.

Granitas and the related sorbets and gelatos are frozen Italian-originated desserts which can be flavored with fruit, wine, or coffee and have become increasingly popular with the development of machines that continuously mix and chill the ingredients. As a dessert, they may be served in a cup. U.S. Pat. No. 4,900,158 is representative of such a machine. U.S. Pat. No. 4,986,994 discloses one recipe for preparing a low calorie version of such a drink, which is commonly sold in English speaking countries as a "slush" drink. U.S. Pat. No. 6,511,693 discloses such a slushy drink in a flexible bag-like container.

Jellied "shooters" made from a gelatin such as Jell-O™, water, and occasionally beverage alcohol in place of some of the water, are popular in bars. They may be cast as a slab and sliced or poured into a cup which serves as a mold. Without the beverage alcohol, they are enjoyed by children.

BRIEF SUMMARY OF THE INVENTION

It is an object of this invention to combine the flavor and content of a shooter with the pleasant mouth feel of a gelatin, granita or slush, and to dispense the combination in a straw.

It is a further objective of the invention to adapt such a straw to a party game such that two or more people may use the straw at the same time.

DETAILED DESCRIPTION OF THE INVENTION

Figure 1:
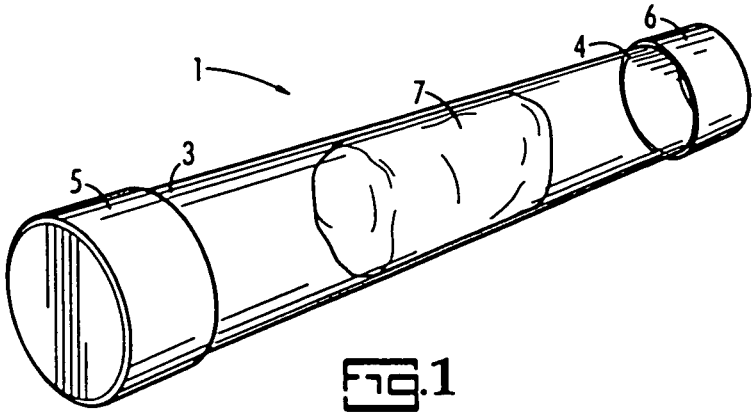
FIG. 1 shows a first embodiment of the invention in the form of a single drinking

The particular composition of the gelatin, granita or slush used in this invention is not critical except that the components should not be adversely affected over time by light or oxygen. Furthermore, the gelatin or slush must be formed at the typical operating temperatures of the refrigerator compartment or freezer compartment of a typical household refrigerator. Beverage alcohol (ethyl alcohol) is not required as a component but may be preferred by adults.

The straw (1) according to this invention is formed from a straw body 2 having ends 3 and 4. Tightly sealing caps 5 and 6 enclose the end. In consideration of the demands for shelf life, preservation of the flavor and compliance with various laws and regulations regarding the sale of alcoholic beverages, the caps 5 and 6 must adhere tightly and be secured with a breakable seal which is only broken by the ultimate purchaser.

The gelatin, granita or slush 7 fills the center bore of the straw.

Straw 2 must be formed from a semi-rigid food grade plastic such as polyethylene, polyvinyl chloride, polyethylene terephthalate (PET) or polypropylene so that the straw maintains a rigidity characteristic of a conventional cellulosic straw but is flexible and deformable sufficiently to kneed of the slush when the straw is removed from a freezer. Food grade PET is preferred. The end caps 5 and 6 may be made from a hard or soft food grade plastic, preferably one that can be heat sealed or attached to the straw with an adhesive during manufacturing.

The straw is envisioned for a "game" when two people insert their respective straw ends into their mouths after the caps have been removed and either try to suck the contents away from the other person or pneumatically push the contents under pressure into the mouth of the other party.

One typical straw would have an I.D. of 0.5 inches (12.7 mm) and a length of approximately 12 inches (304 mm). Such a straw would have a volume of about 25 ml.

A larger straw with a 50 ml capacity may haven an I.D. of 0.75 in. (19 mm), a wall thickness of 0.022 in. (0.56 mm) and a length of 5.5 in. (140 mm). The straw may be sold in appropriate stores and entertainment venues as a preloaded product for a single use. Empty straws may be reloaded by the user with various blends of jellied shooter mix using any recipe which uses a gelatin to obtain consistency. Warm jellied mix or slush mix may be poured into the larger I.D. straw with or without a funnel or syringe and cooled to a suitable temperature.

Figure 2:
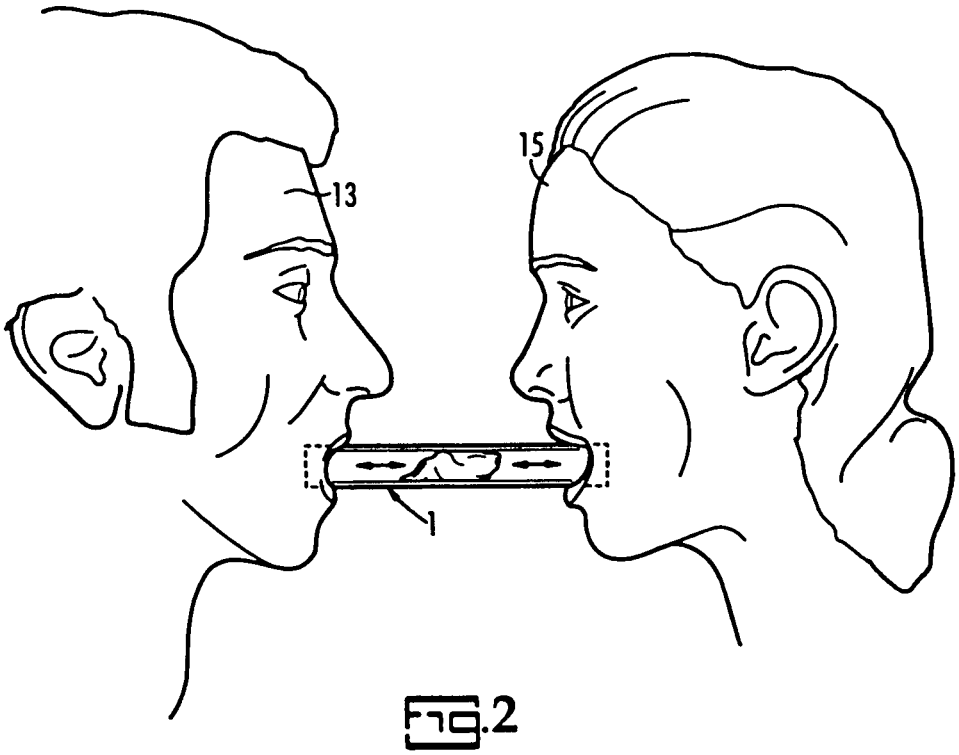
FIG. 2 shows two people sharing a single straw.

FIG. 2 shows the straw 1 being used by two people 13 and 15.

Figure 3:
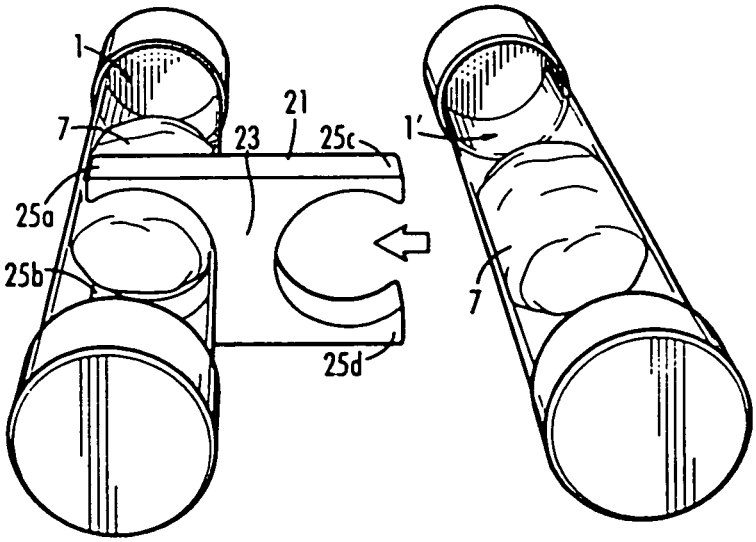
FIG. 3 shows a double straw.

FIG. 3 shows an arrangement for a "double barrel" straw wherein straws 1, 1' are connected by a holder 21 having a base portion 23 from which flexible projections 25*a*, 25*b*, 25*c* and 25*d* project to hold two straws in place. The holder 21 may be integral with two straws but in the preferred embodiment it is detachable and reusable. The "double barrel" straw may be used serially and not require the users to get another straw.

Figure 5:
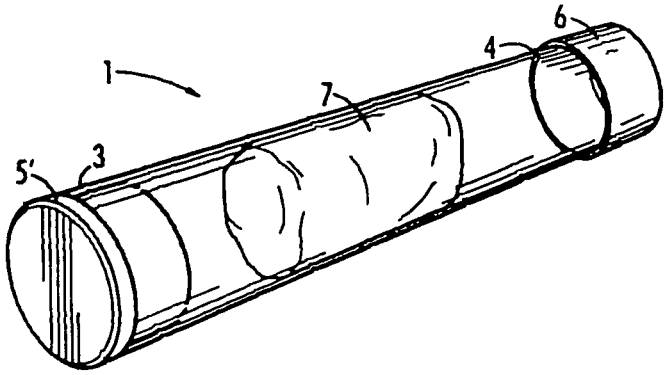
FIG. 5 shows an alternative embodiment of the straw.

FIG. 5 is an alternative embodiment wherein the cap 5 has been replaced by an inserted plug 5'. A constant diameter tube and plug is preferred, even required, for certain automatic filling equipment.

Figure 4:
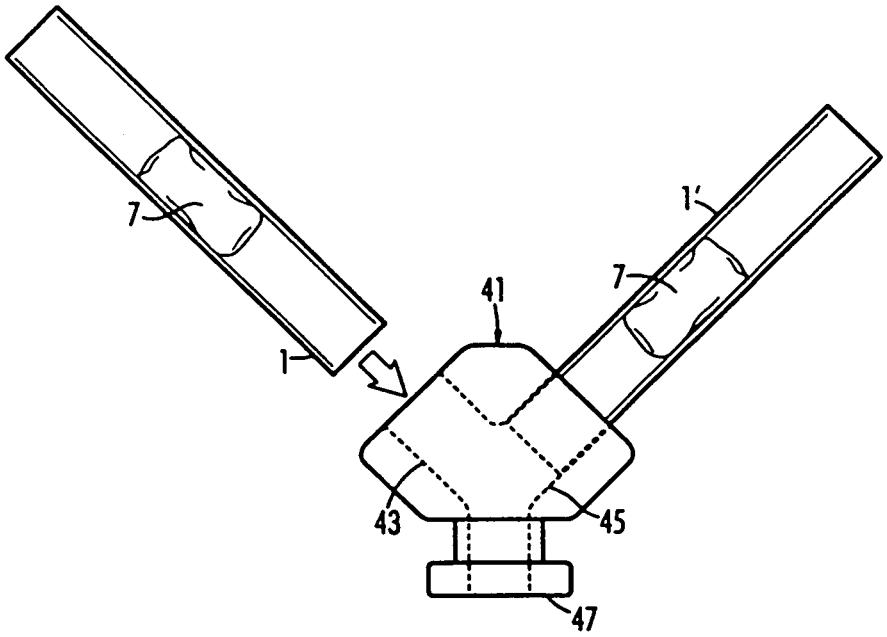
FIG. 4 shows a three-way straw.

FIG. 4 employees a "Y" shaped holder 41 with sockets 43, 45 into which straws 1, 1' may be tightly inserted. A mouthpiece 47 is grasped by the third party. An alternative design replaces mouthpiece 47 with a socket so that a third straw may be used. Open pathways connect the sockets so that the Y shaped holder is a connector for the straws.

The invention has been described in terms of a party straw device used by two people. Alternative designs for three or more people are readily envisioned.

The invention has been described in terms of its preferred embodiments and improvements as may be obvious to one of skill in the art are included within the scope of the invention.

I claim:

1. A process for playing a party game by two people wherein each player inserts an end of a flexible straw into their mouth, said flexible straw having two open ends and said flexible straw contains a semi-solid flavored material selected from the group consisting of jellied drinks, granitas, and slushes between said two open ends and one of said two people sucks and the other of said two people blows into the straw to move the flavored material from the straw into the mouth of said one of said two people.

2. A process for playing a party game wherein two people insert an end of a flexible straw containing a semi-solid flavored material selected from the group consisting of jellied drinks, granitas, and slushes into the mouth and one of said two people sucks while the other of said two people blows into the straw to move the flavored material into the mouth of said one of said two people.

* * * * *